US007412732B1

(12) United States Patent
Leonard

(10) Patent No.: US 7,412,732 B1
(45) Date of Patent: Aug. 19, 2008

(54) TOILET SPLASH GUARDING SYSTEM

(76) Inventor: Larry P. Leonard, 240 13th St., Plainwell, MI (US) 49080

( * ) Notice: Subject to any disclaimer, the term of this patent is extended or adjusted under 35 U.S.C. 154(b) by 3 days.

(21) Appl. No.: 11/502,726

(22) Filed: Aug. 14, 2006

(51) Int. Cl.
*E03D 9/00* (2006.01)

(52) U.S. Cl. ..... 4/300.3; 4/661; 4/DIG. 5

(58) Field of Classification Search ..... 4/300.3, 4/301, 902, DIG. 5, 234–241, 661; D23/310–311
See application file for complete search history.

(56) References Cited

U.S. PATENT DOCUMENTS 134,315 A * 12/1872 Robinson ..... 4/301
2,791,780 A * 5/1957 Krischer ..... 434/247
3,193,845 A * 7/1965 Funk ..... 4/300.3
4,060,859 A * 12/1977 Anderson ..... 4/307
4,348,776 A * 9/1982 Sarjeant ..... 4/300.3
D384,139 S * 9/1997 Tribolet ..... D23/311
6,408,447 B1 * 6/2002 Burbank et al. ..... 4/300.3

* cited by examiner

*Primary Examiner*—Khoa D Huynh

(57) ABSTRACT

In a toilet splash guarding system, a splashguard is placed between a toilet bowl and a toilet seat so as to pop up and take an operational shape when the seat is lifted. The splashguard is attached to the bowl by means of suction cups and to the seat by a strap. It is provided with a hole of adjustable size made in the frontal surface, whereby urine and water are prevented from being splattered on and around the bowl.

5 Claims, 5 Drawing Sheets

TOILET SPLASH GUARDING SYSTEM

FIELD OF THE INVENTION

The present invention relates to a urinating aid for a toilet. More particularly, it relates to a toilet cover, which includes a collapsible splash shield.

BACKGROUND OF THE INVENTION

Cleanliness and hygiene is a primary consideration in a bathroom, which requires special cleaners and detergents due to the nature of the bacteria. As is well known and understood in the art, a very common problem, and one of the chief causes of the unsanitary conditions found in the bathroom, particularly associated with men and boys, is the problem of splashing. The splashing causes problems of odor, soil and the like, in most cases behind the toilet seat and on the floor to the rear of the toilet and beneath the toilet tank. These problems can be further exaggerated in hospitals and other large facilities where many people use the bathrooms or where elderly or infirm individuals use the bathrooms.

Various attempts have been made to solve the problems of cleanliness and hygiene. For example, U.S. Pat. No. 4,133,062 for "Lifting apparatus for toilet seat" issued on 1979 Jan. 9 to Burley R. Fulbright, Jr., discloses a spring loaded lifting apparatus with a retractable splash shield connected to the toilet seat and the rim of the toilet bowl. The connection of the splash shield allows for frontal access to the bowl by a male while shielding the back and sides of the toilet bowl. The entire pivot mechanism for the toilet seat and cover is changed to the new spring-loaded system. This not only makes for a displeasing appearance, but the shielding means still leaves open the front half of the toilet bowl thus not completely preventing splashing.

According to U.S. Pat. No. 4,348,776 for "Collapsible splash shield for toilet" authored by Dale C. Sarjeant and published on 14 Sep. 1982, a collapsible splash guard is provided which is adapted to be mounted in a toilet, and which is constructed for movement between an extended operative position when the toilet seat is in a raised position and a collapsed storage position when the seat is in a lowered position. The splashguard comprises a plurality of segments assembled in nested relation with one another and normally arranged in a collapsed storage position within the bowl of the toilet when the seat of the toilet is in the lowered position. The innermost of the nested segments is connected to the toilet seat in such a manner that when the toilet seat is lifted to the raised position, the innermost segment is lifted upwardly from within the bowl and the nested segments are moved with respect to one another from a nested relationship into an extended overlapping relationship positioned above the toilet bowl and forming an enclosure shieldingly surrounding the back and side portions of the bowl.

Disclosed in U.S. Pat. No. 5,276,925 for "Retractable urinal for toilet seat" authored by Frank Blaha and published on 11 Jan. 1994 is a urinating aid for use with a commode having a bowl and seat including a cover with a front end and a back end. The back end is pivotally connected to the seat. The cover includes a lower lid and an upper lid pivotally connected to the lower lid for movement between an open and a closed position. A collapsible shield is connected to the upper lid and the lower lid. A raising and lowering plate moves the shield between a lowered inoperative position and a raised operative position so that when the upper lid is closed, the shield is in the lowered inoperative position. When the upper lid is opened, the raising and lowering plate moves the shield between the lowered inoperative position and the raised operative position to provide a raised urinating aid.

According to U.S. Pat. No. 5,564,135 for "Toilet bowl splash guard" authored by Clifford D. Jones et al. and published on 15 Oct. 1996, a collapsible splashguard is provided that is relatively permanently secured to the lower surface of a toilet seat. The splashguard includes a base plate shaped and sized to substantially conform with the shape and size of the toilet bowl rim, a pleated, substantially U-shaped splash shield, and attachment members for attaching a first portion of the splash shield to the base plate. The splashguard also includes pivotal securing members for pivotally securing a second portion of the splash shield to the base plate and members for hingedly attaching the splashguard to the lower face of the toilet seat. The attachment members can either permanently or removable attach the first portion of the splashguard to the base plate. The splashguard can further include a flange which extends downwardly from an inner edge of the base plate such that the attachment members either permanently or removably attach the first portion of the splash shield to an inner face of the flange. The splashguard can further include a wall extending upwardly along an outer edge of the base plate. The toilet seat rests on the top surface of the upwardly extending wall when the seat is in a lowered position. The splashguard can further includes three pairs of elongate lift arm members. Hinges to the base plate secure the first pair of elongated members. Each of the second pair of elongated lift members is hingedly secured to one of the first pair of elongated members. Each of the third pair of elongated lift members is hingedly secured to one of the second pair of elongated members and is also hingedly secured to the lower face of the seat.

Known from U.S. Pat. No. 5,815,851 for "Collapsible urinal splash shield" authored by Reginald S. Perry and published on 6 Oct. 1998 is a urinating splash shield for use with conventional toilets, which includes a splash shield and radial attachment ring. The splash shield is flipped up for use and down for nonuse. The attachment ring enables the splash shield to seat within the toilet bowl mouth. The device isolates the toilet seat from the urine stream thereby negating any additional need to clean the toilet seat.

Disclosed in a U.S. Pat. No. 6,305,034 for "Extensible and retractable urine deflecting apparatus for use with a toilet" published on 23 Oct. 2001 and authored by Jose Miguel Perez Urrutia, is an extensible and retractable urine deflecting apparatus for use in combination with a toilet and toilet bowl. The apparatus comprises three distinct segments all contiguously connected. Preferably the 1st segment consists of a pair of flush mounted attach, connect, and support structures, but may be limited to one. Preferably the 2nd segment consists of a pair of extensible and retractable mechanical arms, but may be limited to one. The 3rd Segment consists of a urine deflecting device or any of various methods including but not limited to absorbent paper, cascading water, stream of air, or lightweight mini urinal device. The extensible and retractable urine deflecting apparatus readily converts any typical toilet into a fully functional urinal so that a user from a non sitting position may reliably deliver and deposit a stream of urine by first deflecting and then redirecting the urine into the intended inside portion of the toilet bowl in a sanitary fashion. The extensible and retractable urine deflecting apparatus provides a closer target of superior angle. The urinal mode easily converts back to toilet mode and both modes share the same drain.

U.S. Pat. No. 6,385,785 for "Urine shield removably attached to toilet seat" issued on 14 May 2002 to Carol S. Linden discloses a rectangular flexible shield that is placed into the toilet bowl shielding the back and sides of the bowl to prevent or reduce urine spills. The urine shield is removably attached to the raised toilet bowl seat by a generally unshaped hook.

A need exists for a simple-in-structure and easy in use and convenient toilet seat cover, which includes a collapsible splash shield.

SUMMARY OF THE INVENTION

According to the present invention, there is provided a toilet splash guarding system with a splashguard adapted to be placed between a toilet bowl and a toilet seat. The toilet seat is attached to the toilet bowl by hinges, the splashguard is attached to the toilet bowl and to the toilet seat so as to pop up and take an operational shape when the seat is lifted. A frontal surface of the splashguard in an operational position thereof faces a user, and the splashguard is provided with a hole of adjustable size made in the frontal surface. Thanks to these features, urine and water are prevented from being splattered on and around the bowl.

The splashguard is made of collapsible plastic and the attachment of the splashguard to the bowl is effected by a plurality of suction cups. Tops of the suction cups are fastened to the splashguard and the suction cups are placed with their suction surfaces on a ledge of the bowl to fasten on it. There are preferably four suction cups. The attachment of the splashguard to the seat is effected by a strap.

The adjustable size of the hole is realized by providing a flap adapted to adjustably cover the hole.

The above-identified features are believed to fulfill the need for a convenient, simple, and easy in use toilet splash guarding system.

BRIEF DESCRIPTION OF DRAWINGS

Other objects, features and advantages of the invention will become apparent to one skilled in the art by reading the following specification and subjoined claims and by referencing the following drawings, in which:

DETAILED DESCRIPTION

Figure 1:
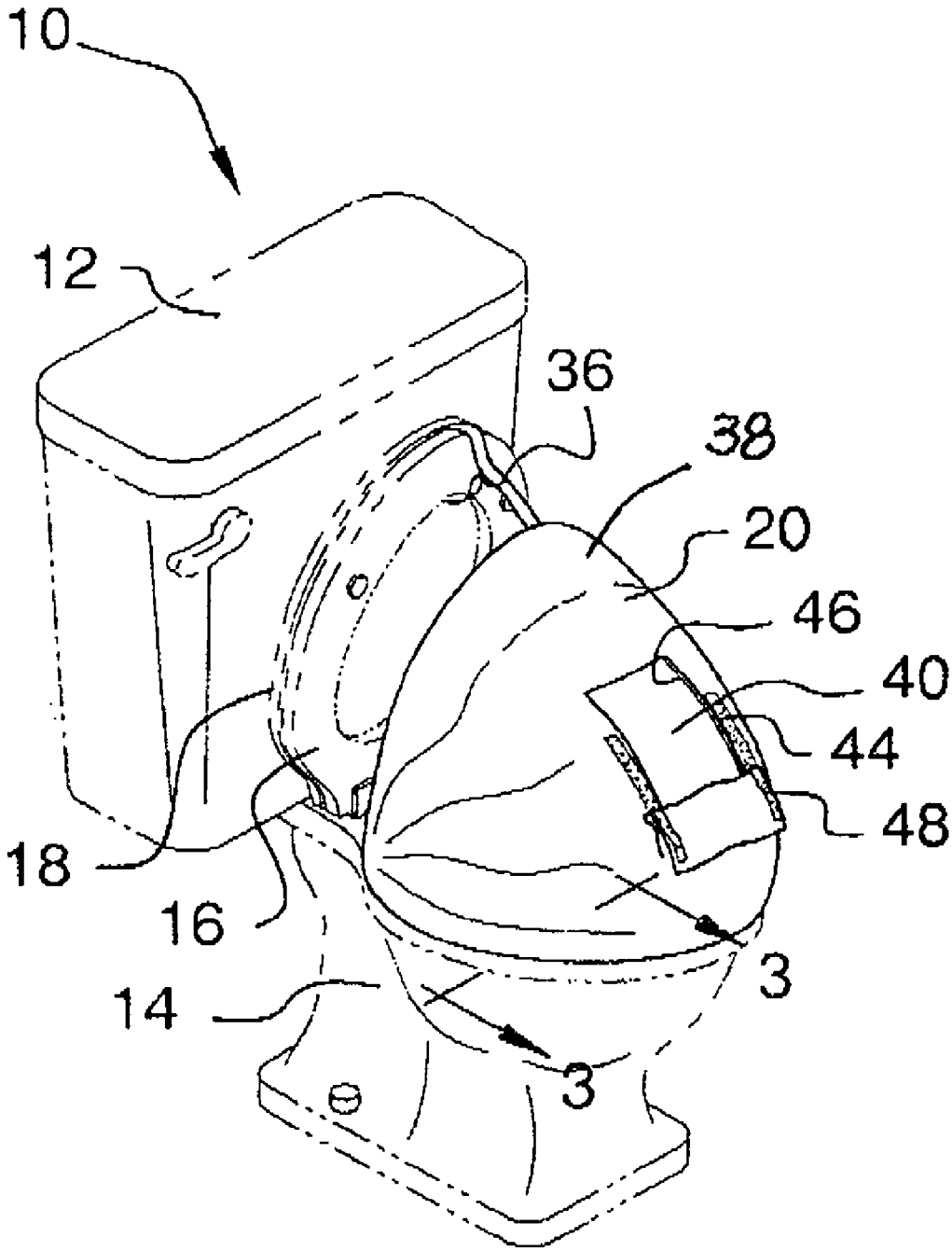
FIG. 1 shows a perspective view of the toilet splash guarding system according to the present invention in an operational position thereof.
Figure 2:
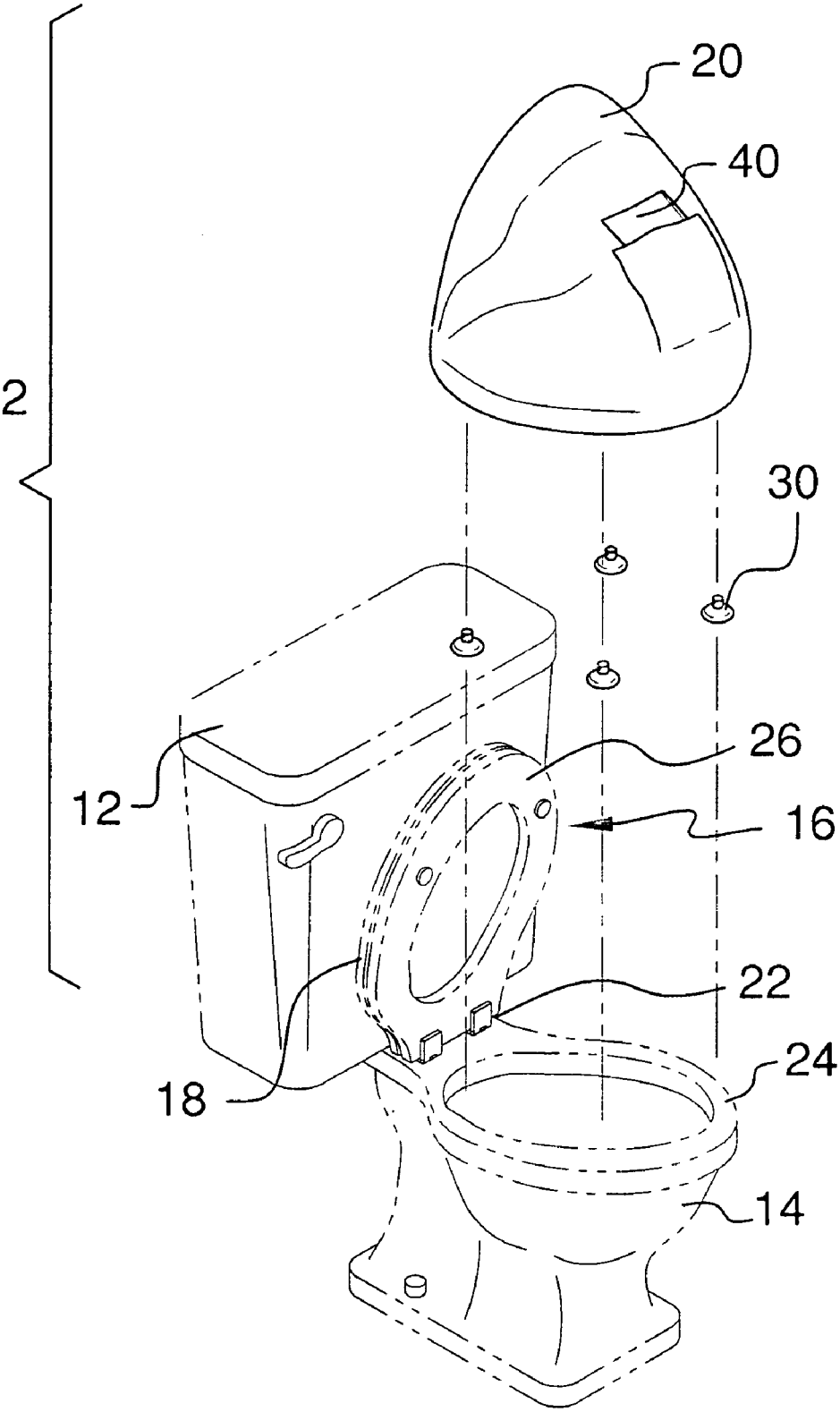
FIG. 2 is an exploded view of the toilet splash guarding system according to the present invention.
Figure 3:
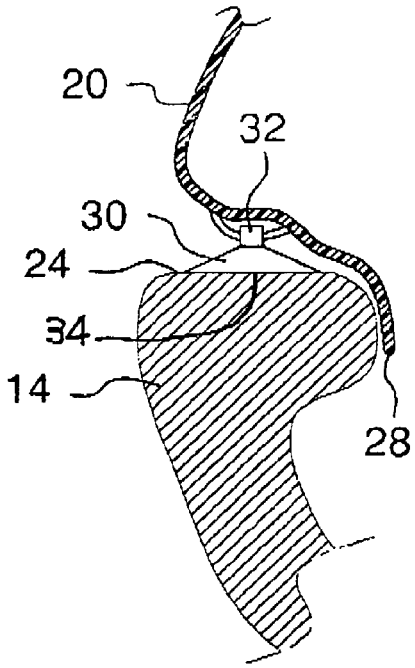
FIG. 3 is a cross-section of a portion of the toilet splash guarding system taken along lines 3-3 in FIG. 1.
Figure 4:
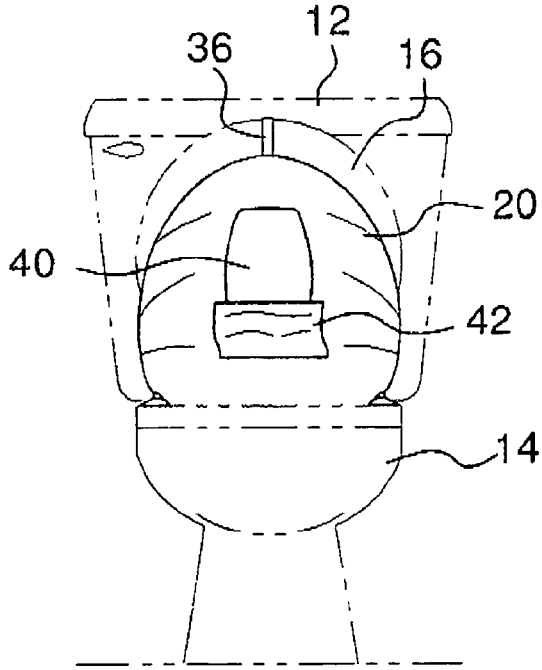
FIG. 4 is a front view of the toilet splash guarding system in an operational position.
Figure 5:
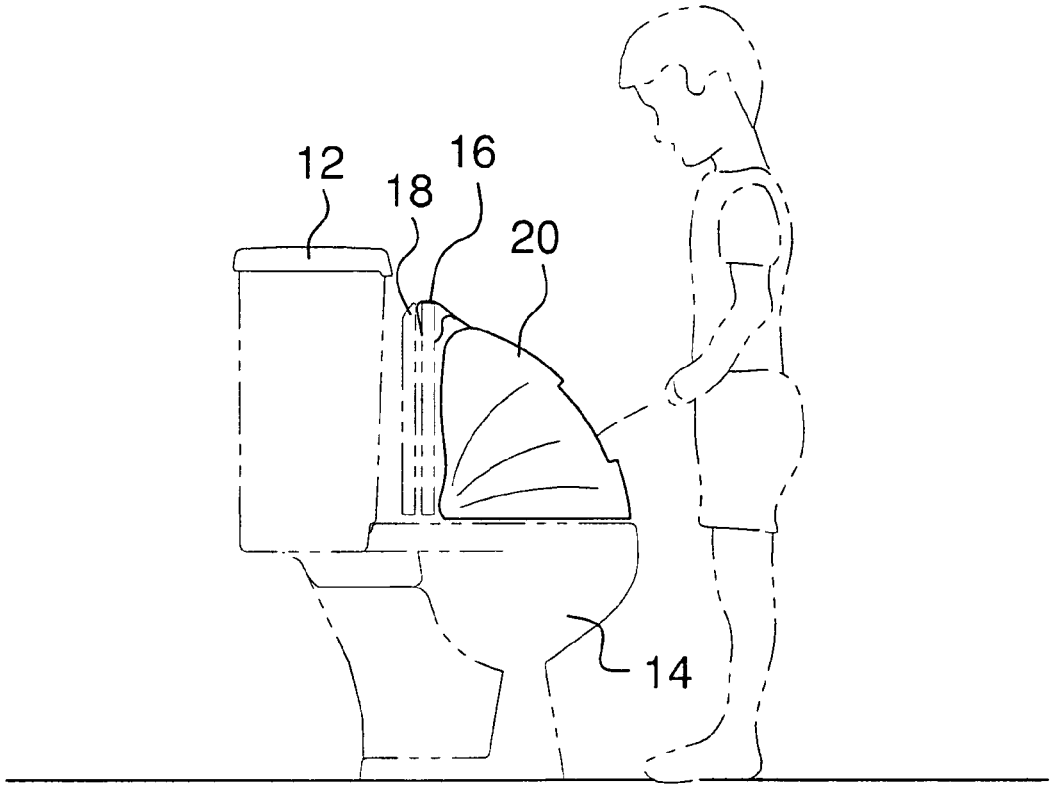
FIG. 5 illustrates a boy using the toilet splash guarding system.
Figure 6:
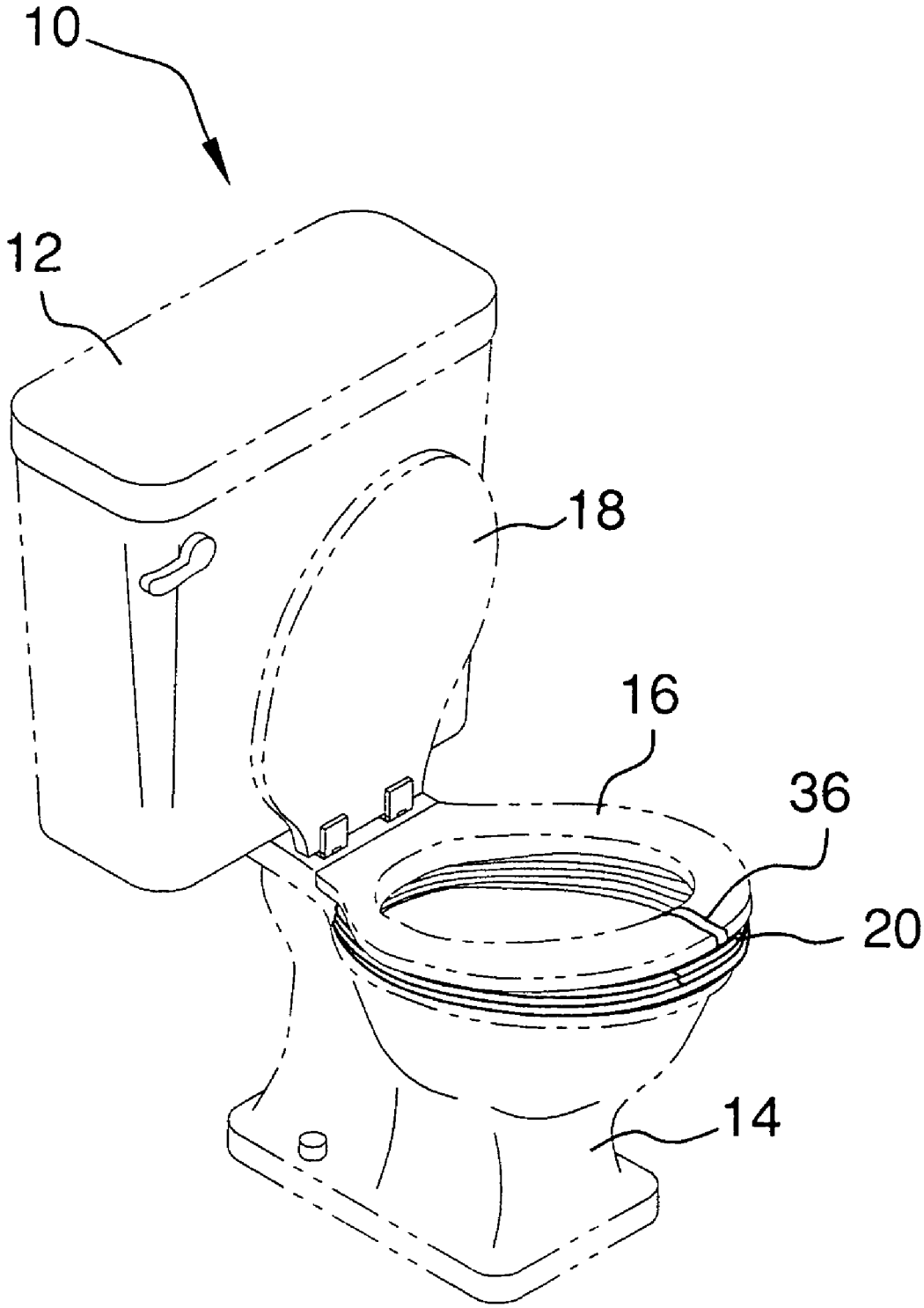
FIG. 6 shows a perspective view of the toilet splash guarding system according to the present invention, with the splashguard collapsed.

Referring now to FIGS. 1-6, a toilet splash guarding system 10 according to the present invention comprises a tank 12, a toilet bowl 14, a toilet seat 16 with a cover 18, and a splashguard 20. The toilet seat 16 is attached to the toilet bowl 14 by means of hinges 22. An upper surface of the toilet bowl 14 defines an upper, substantially annular toilet bowl rim 24, whereas the toilet seat 16 has a lower face 26 facing the rim 24.

The splashguard 20 is mounted between the rim 24 and the lower face 26. By its shape, the splashguard 20 looks like a quarter of the surface of a sphere. An edge 28 of the splashguard 20 finds its way behind the rim 24 into the bowl 14. The splashguard 20 is made of plastic that is able to collapse. It is attached to the toilet bowl rim 24 by means of suction cups 30. Tops 32 of the suction cups 30 are attached to the splashguard 20, whereas suction surfaces 34 of the suction cups 30 face the toilet bowl rim 24 and can be fastened thereto. In a preferred embodiment, there are four suction cups 30, two on each side of the rim 24, though the number of the cups 30 and their location on the rim 24 can vary.

The splashguard 20 is attached to the lower face 26 of the toilet seat 16 by means of a strap 36. A front surface 38 of the splashguard 20 is provided with a hole 40. Also, the splashguard 20 is provided with a flap 42 that can vary openness of the hole 40 adjustably covering it. This can be effected due to fasteners 44 attached near edges 46 of the hole 40 and fasteners 48 attached to the flap 42. The fasteners 44 and 48 may include a hook-and-loop fastener such as VELCRO® tape.

When the seat 16 is lowered (FIG. 6), the splashguard 20 is compressed between the lower face 26 of the seat 16 and would pop into shape when the toilet seat is lifted. The user would urinate in the toilet in the usual manner. However, the system would redirect the a urine stream and toilet water sprinkles back into the bowl 14 to eliminate the splashing that occurs when a person urinates directly into the bowl.

The system according to the present invention would not only provide a means of containing urine and water splash in the bowl, but would also prevent an errant stream of urine from soiling the seat, floor, etc. The round or dome-shaped splashguard, measuring, for instance, 24 inches high and 12 inches long, could be produced in various colors, sizes, shapes, and styles to coordinate with any bathroom décor. It could be also offered in disposable and reusable versions.

The appealing features of the toilet splash guarding system according to the present invention would be the improved sanitary conditions it would provide, as well as its ease of use, practicality, convenience, light weight, compact size, effectiveness, cost-savings, and novel design. The system could eliminate some of the mess often found in bathrooms. It would effectively reduce splashes when urinating. With this system, males could rest knowing that they could safely use the toilet without embarrassing and unsanitary splashes. The system would keep the flow of urine in the toilet bowl. The urine gathers on the back of the toilet bowl and can also drip onto the floor. With this system, males could leave a bathroom reassured that they had not left a mess. This system would eliminate costly replacements of flooring because of penetrating odors and stains caused by splashed urine. The system would not hinder the use of the toilet in any way. Splashes on the seat or clothing and embarrassing splatter noises would not occur with the use of this system. It would save individuals a considerable amount of time and energy while cleaning the bathroom. Thus, it could be particularly beneficial to the elderly who may have difficulties bending over to clean around the toilet area. The system could also appeal to families with toilet training youngsters. Various colors and patterns could be provided to encourage children, particularly boys, to urinate directly into the bowl. The system would be adjustable, sanitary, effective, practical, easy to use, simple to install, and reasonably priced.

Those skilled in the art can now appreciate from the foregoing description that the broad teachings of the present invention can be implemented in a variety of forms. Therefore, while this invention has been described in connection with a particular example thereof, the true scope of the invention should not be so limited since other modifications will become apparent to the skilled practitioner upon a study of the drawings, specification and claims that follow.

The invention claimed is:

1. A toilet splash guarding system with a splashguard to be placed between a toilet bowl and a toilet seat; the toilet bowl having a front end, a back end and an upper surface defining a substantially annular rim; a water tank located at the back end of the toilet bowl, wherein the water tank supplying water for flushing wastes inside the toilet bowl; the toilet seat having a lower face facing the rim, the toilet seat being attached to the toilet bowl by hinges which located at the back end of the toilet bowl; the splashguard having a first end being attached to the rim of toilet bowl and a second opposite end being attached to the lower face the toilet seat such that the splashguard pop-ups and takes an operational shape and position when the seat is pivotally lifted up and away from the rim of the toilet bowl, whereby a frontal surface of the splashguard in the operational position thereof facing a user; the splashguard being provided with a hole of adjustable opening formed in the frontal surface of the splashguard; the hole allowing a user to pass urine therethrough; wherein the opening of the hole is adjusted to various sizes by a flap, disposed on the frontal surface of the splashguard, that adjustably covers the hole; and whereby urine and water are prevented from being splattered on and around the bowl.

2. The toilet splash guarding system as claimed in claim 1, wherein the splashguard is made of collapsible plastic.

3. The toilet splash guarding system as claimed in claim 1, wherein the attachment of the splashguard to the bowl is effected by a plurality of suction cups, tops of the suction cups being fastened to the splashguard and the suction cups being placed with suction surface thereof on a ledge of the bowl to fasten thereon.

4. The toilet splash guarding system as claimed in claim 3, wherein the plurality of suction cups includes four suction cups.

5. The toilet splash guarding system as claimed in claim 1, wherein the attachment of the splashguard to the seat is effected by a strap.

* * * * *